US009422649B2

(12) United States Patent
Fang et al.

(10) Patent No.: US 9,422,649 B2
(45) Date of Patent: Aug. 23, 2016

(54) PREPARATION METHOD OF A JACQUARD SANDWICH FABRIC WITH SURFACE INLAID WITH YARNS IN REVERSE

(71) Applicant: FUJIAN HUAFENG NEW MATERIALS CO., LTD., Fujian (CN)

(72) Inventors: Huayu Fang, Fujian (CN); Huashan Fang, Fujian (CN); Tianyu Xu, Fujian (CN); Dehua Yang, Fujian (CN); Zhijian Fang, Fujian (CN); Tianyuan Li, Fujian (CN); Jiantong Wu, Fujian (CN); Daneshvar Kamran, Fujian (CN)

(73) Assignee: FUJIAN HUAFENG NEW MATERIALS CO., LTD., Fujian (CN)

( * ) Notice: Subject to any disclaimer, the term of this patent is extended or adjusted under 35 U.S.C. 154(b) by 0 days.

(21) Appl. No.: 14/769,450

(22) PCT Filed: Apr. 2, 2014

(86) PCT No.: PCT/CN2014/074647

§ 371 (c)(1),
(2) Date: Aug. 20, 2015

(87) PCT Pub. No.: WO2015/149306

PCT Pub. Date: Oct. 8, 2015

(65) Prior Publication Data

US 2016/0053416 A1 Feb. 25, 2016

(51) Int. Cl.

| | |
|---|---|
| ***D04B 21/08*** | (2006.01) |
| ***D04B 37/04*** | (2006.01) |
| ***D04B 21/06*** | (2006.01) |
| ***D04B 21/20*** | (2006.01) |

(52) U.S. Cl.

CPC ..... *D04B 21/08* (2013.01); *D04B 21/06* (2013.01); *D04B 21/20* (2013.01); *D04B 37/04* (2013.01)

(58) Field of Classification Search

CPC ..... D04B 21/06; D04B 21/08; D04B 21/10; D04B 21/12; D04B 23/02

See application file for complete search history.

(56) References Cited

U.S. PATENT DOCUMENTS

| | | | | | |
|---|---|---|---|---|---|
| 3,834,193 | A * | 9/1974 | Wilkens | D04B 27/32 | 66/195 |
| 3,879,964 | A * | 4/1975 | Pascual | D04B 21/06 | 66/190 |
| 3,999,407 | A * | 12/1976 | Odham | D04B 21/18 | 66/193 |
| 5,150,587 | A * | 9/1992 | Bergmann | D04B 21/02 | 66/195 |

* cited by examiner

*Primary Examiner* — Danny Worrell

(74) *Attorney, Agent, or Firm* — Stein IP, LLC

(57) ABSTRACT

A preparation method of a jacquard sandwich fabric with a surface inlaid with yarns in reverse is disclosed, employing double-needle bar sandwich warp knitting machine, comprising the following steps: 1) reversely inlaying yarns; 2) redefining the basic stitch of the jacquard, designing two basic stitches; 3) designing patterns using color (16) and color (20) according to the actual fabric needs, and drawing; 4) directly raising a pattern through a jacquard guide bar; 5) converting the designed pattern into a graphic diagram, and continuously modifying the pattern through the graphic diagram; 6) after finishing the pattern design, producing the finished fabric product. The fabric only has two basic stitches, and when designing the jacquard pattern, only color (16) and color (20) are needed for drawing, thus reducing half of the basic stitch color and reducing at least half the design steps. The reverse yarn inlaying process and the ground guide bar process are employed to realize reversely inlaid yarns on the surface of the jacquard sandwich fabric.

4 Claims, No Drawings

PREPARATION METHOD OF A JACQUARD SANDWICH FABRIC WITH SURFACE INLAID WITH YARNS IN REVERSE

CROSS-REFERENCE TO RELATED APPLICATIONS

This application is a national stage of International Application No. PCT/CN2014/074647, filed Apr. 2, 2014, in the State Intellectual Property Office (SIPO), the disclosure of which is incorporated herein by reference.

TECHNICAL FIELD

The present invention relates to a preparation process of a jacquard sandwich fabric, in particular to a preparation method of a jacquard sandwich fabric with a surface inlaid with yarns in reverse.

DESCRIPTION OF THE RELATED ART

At present, jacquard sandwich machines are equipped with a ground guide bar and a jacquard guide bar, forming different patterns through various permutations and combinations; the process of the ground guide bar is usually that of a chain stitch (1-0-1-1/0-1-1-1//), with the yarns fully threaded.

BRIEF SUMMARY OF THE INVENTION

The objective of the present invention is to provide an application of the reverse yarn inlaying process and ground guide bar process to a double-needle bar sandwich warp knitting machine to realize the preparation method of a jacquard sandwich fabric with surface inlaid with yarns in reverse.

To fulfill the above objective, the present invention employs the following technical solution:

A preparation method of a jacquard sandwich fabric with a surface inlaid with yarns in reverse, employing a double-needle bar sandwich warp knitting machine, comprises the following steps:

1) reversely inlaying the yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

2) re-defining the basic stitch of jacquard, designing two basic stitches: basic stitch A: realizing an "extension line" effect, defining as the color (16), namely light red; basic stitch B: realizing a "mesh hole" effect, defining as the color (20), namely light blue;

3) designing patterns using color (16) and color (20) according to the actual fabric needs, and drawing;

4) directly raising the pattern through the jacquard guide bar;

5) converting the designed pattern into a simulation diagram and continuously modifying the pattern through the simulation diagram;

6) after finishing the pattern design, directly exporting a looming document, importing the document into a machine file, and producing the finished fabric product.

To fulfill the above objective, the present invention employs another technical solution:

A preparation method of a jacquard sandwich fabric with a surface inlaid with yarns in reverse, employing a double-needle bar sandwich warp knitting machine, comprises the following steps:

1) reversely inlaying the yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

2) re-defining the basic stitch of jacquard, designing two basic stitches: basic stitch A: realizing an "extension line" effect, defining as the color (16), namely light red; basic stitch B: realizing a "mesh hole" effect, defining as the color (20), namely light blue;

3) designing patterns using color (16) and color (20) according to the actual fabric needs, and drawing;

4) using a ground guide bar and a jacquard guide bar to raise the pattern, wherein the yarn inlaid stitch of the ground guide bar is 1-0-1-1/0-1-1-1//;

5) converting the designed pattern into a graphic diagram and continuously modifying the pattern through the graphic diagram;

6) after finishing the pattern design, directly exporting a knitting document, importing the document into a machine file, and producing the finished fabric product.

wherein, in step 4), the ground guide bar works in a part-set threading mode; the ground guide bar works with polyester yarns, while the jacquard guide bar works with nylon yarns.

To fulfill the above objective, the present invention employs another technical solution:

A preparation method of a jacquard sandwich fabric with a surface inlaid with yarns in reverse, employing a double-needle bar sandwich warp knitting machine, comprises the following steps:

1) reversely inlaying the yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

2) re-defining the basic stitch of jacquard, designing two basic stitches: basic stitch A: realizing an "extension line" effect, defining as the color (16), namely light red; basic stitch B: realizing a "mesh hole" effect, defining as the color (20), namely light blue;

3) designing patterns using color (16) and color (20) according to the actual fabric needs, and drawing;

4) using two ground guide bars and a jacquard guide bar to raise the pattern, wherein the yarn inlaid stitch of the first ground guide bar is 1-0/1-2/2-3/3-4/4-5/4-3/3-2/2-1// and the yarn inlaid stitch of the second ground guide bar is 4-5/4-3/3-2/2-1/1-0/1-2/2-3/3-4//;

5) converting the designed pattern into a graphic diagram and continuously modifying the pattern through the graphic diagram;

6) after finishing the pattern design, directly exporting a knitting document, importing the document into a machine file, and producing the finished fabric product.

The present invention has the following beneficial effects: The fabric only has two basic stitches, and during the design of the jacquard pattern, only color (16) and color (20) are needed for drawing, thus reducing half of the basic stitch color and reducing at least half the design steps. The design interface of the pattern gets simple, and it is easy to modify complicated patterns. The reverse yarn inlaying process and the ground guide bar process are employed to realize reversely inlaid yarns on the surface of the jacquard sandwich fabric.

DETAILED DESCRIPTION OF THE PRESENT INVENTION

The technical contents, structure characteristics, fulfilled objective and effects of the present invention are described in detail with reference to the embodiments.

Jacquard guide bar: Guide bar equipped with a jacquard comb.

Ground guide bar: Guide bar equipped with common guide needles.

A preparation method of a jacquard sandwich fabric with a surface inlaid with yarns in reverse, employing a double-needle bar sandwich warp knitting machine, comprising the following steps:

1) reversely inlay the yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

Before modification, the yarn inlaid stitch of the jacquard guide bars JB1.1 and JB1.2 are both 1-0-1-1/1-2-1-1//, called "homodromous yarn inlaid stitch". The current double-needle bar sandwich machine also has such configuration. The modified machine has two ground guide bars with patterns designed independently. In the general pattern design, use of zero, one, or two ground guide bars is allowed. The ground guide bar may be of full-set threading or part-set threading. The patterns and colors are very diversified.

2) re-defining the basic stitch of jacquard, designing two basic stitches: basic stitch A: realizing an "extension line" effect, defining as the color (16), namely light red; basic stitch B: realizing a "mesh hole" effect, defining as the color (20), namely light blue;

3) Design patterns using color (16) and color (20) according to the actual fabric needs, and drawing;

4) There are the following three cases of ground guide bar design:

Case 1: Directly raise the pattern through the jacquard guide bar;

Case 2: Use a ground guide bar and a jacquard guide bar to raise the pattern, wherein the yarn inlaid stitch of the ground guide bar is 1-0-1-1/0-1-1-1//; the ground guide bar employs the part-set threading mode; the ground guide bar works with the terylene yarns, while the jacquard guide bar works with the chinlon yarns.

Case 3: Use two ground guide bars and a jacquard guide bar to raise the pattern, wherein the yarn inlaid stitch of the first ground guide bar is 1-0/1-2/2-3/3-4/4-5/4-3/3-2/2-1// and the yarn inlaid stitch of the second ground guide bar is 4-5/4-3/3-2/2-1/1-0/1-2/2-3/3-4//.

5) Convert the designed pattern into a simulation diagram and continuously modify the pattern through the simulation diagram. The fabric only has two basic stitches, and when designing the jacquard pattern, only color (16) and color (20) are needed for drawing, thus reducing half of the basic stitch color and reducing at least half the design steps. The design interface of the pattern becomes simple, and it is easy to modify complicated patterns.

6) After finishing the pattern design, directly export a knitting document, import the document into a machine file, and produce the finished fabric product.

The above are only some embodiments of the present invention and shall not be regarded as a limit to the present invention. Any equivalent structure or equivalent flow modifications made on the basis of the description of the present invention, or direct or indirect applications to other related fields shall fall within the protective scope of the present invention.

What is claimed is:

1. A preparation method of a jacquard sandwich fabric with a surface inlaid with yarns in reverse, employing a double-needle bar sandwich warp knitting machine, comprising:

1) reversely inlaying a yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

2) re-defining a basic stitch of jacquard, designing two basic stitches: basic stitch A: realizing an extension line effect, defining as a first color being light red; basic stitch B: realizing a mesh hole effect, defining as a second color being light blue;

3) design patterns using the first color and the second color according to the actual fabric needs, and drawing;

4) directly raising the pattern through the jacquard guide bar;

5) converting the designed pattern into a graphic diagram and continuously modifying the pattern through the graphic diagram;

6) after finishing the pattern design, directly exporting a knitting document, importing the document into a machine file, and producing the finished fabric product.

2. A preparation method of a jacquard sandwich fabric with a surface inlaid with yarns in reverse, employing a double-needle bar sandwich warp knitting machine, comprising:

1) reversely inlaying a yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting the yarn inlaid stitch of the jacquard guide bar JB1.1 into 1-0-1-1/1-2-1-1//;

setting the yarn inlaid stitch of the jacquard guide bar JB1.2 into 1-2-1-1/1-0-1-1//;

2) re-defining a basic stitch of jacquard, designing two basic stitches: basic stitch A: realizing an extension line effect, defining as a first color being light red; basic stitch B: realizing a mesh hole effect, defining as a second color being light blue;

3) designing patterns using the first color and the second color according to the actual fabric needs, and drawing;

4) using a ground guide bar and a jacquard guide bar to raise the pattern, wherein the yarn inlaid stitch of the ground guide bar is 1-0-1-1/0-1-1-1//;

5) converting the designed pattern into a simulation diagram and continuously modifying the pattern through the simulation diagram;

6) after finishing the pattern design, directly exporting a looming document, importing the document into a machine file, and producing the finished fabric product.

3. The preparation method of a jacquard sandwich fabric with a surface inlaid with yarns in reverse according to claim 2, wherein in the step 4, the ground guide bar employs the part-set threading mode; and the ground guide bar works with the terylene yarns, while the jacquard guide bar works with the chinlon yarns.

4. A preparation method of a jacquard sandwich fabric with a surface inlaid with yarns in reverse, employing a double-needle bar sandwich warp knitting machine, comprising:

1) reversely inlaying the yarn stitch: dividing a full-gauge jacquard guide bar into two half-gauge jacquard guide bars, with the definitions below:

dividing a jacquard guide bar JB1 into two half-gauge jacquard guide bars JB1.1 and JB1.2;

setting a yarn inlaid stitch of the jacquard guide bar JB1.1 into 1-0-1-1/1-2-1-1//;

setting a yarn inlaid stitch of the jacquard guide bar JB1.2 into 1-2-1-1/1-0-1-1//;

2) re-defining a basic stitch of jacquard, designing two basic stitches: basic stitch A: realizing an extension line effect, defining as a first color being light red; basic stitch B: realizing a mesh hole effect, defining as a second color being light blue;

3) designing patterns using the first color and the second color according to the actual fabric needs, and drawing;

4) using two ground guide bars and a jacquard guide bar to raise the pattern, wherein the yarn inlaid stitch of the first ground guide bar is 1-0/1-2/2-3/3-4/4-5/4-3/3-2/2-1// and the yarn inlaid stitch of the second ground guide bar is 4-5/4-3/3-2/2-1/1-0/1-2/2-3/3-4//;

5) converting the designed pattern into a graphic diagram and continuously modifying the pattern through the graphic diagram;

6) after finishing the pattern design, directly exporting a knitting document, importing the document into a machine file, and producing the finished fabric product.

* * * * *